United States Patent [19]

Yeou

[11] 4,179,981

[45] Dec. 25, 1979

[54] DEVICE FOR SEQUENTIALLY SUPPLYING SEVERAL HYDRAULIC MOTORS

[75] Inventor: Victor Yeou, Meaux, France

[73] Assignee: Poclain, Le Plessis-Belleville, France

[21] Appl. No.: 905,362

[22] Filed: May 11, 1978

Related U.S. Application Data

[62] Division of Ser. No. 733,957, Oct. 19, 1976, abandoned.

[30] Foreign Application Priority Data

Oct. 30, 1975 [FR] France ..... 75 33215

[51] Int. Cl.[2] ..... F15B 13/04

[52] U.S. Cl. ..... 91/33; 91/447; 91/517; 91/518; 91/510; 91/531

[58] Field of Search ..... 60/426, 461, 421, 427; 91/6, 32, 33, 447, 511, 517, 518, 525, 526, 529, 530, 531, 510, 523, 536

[56] References Cited

U.S. PATENT DOCUMENTS

| | | | |
|---|---|---|---|
| 2,979,908 | 4/1961 | Shook | 60/421 |
| 3,354,789 | 11/1967 | Schenkelberger | 91/413 |
| 3,543,516 | 12/1970 | Treichel | 91/414 |
| 3,720,059 | 3/1973 | Schurawski | 60/421 |
| 3,760,689 | 9/1973 | Johnston | 60/421 |

FOREIGN PATENT DOCUMENTS

| | | | |
|---|---|---|---|
| 648962 | 11/1962 | Italy | 91/413 |

*Primary Examiner*—Abraham Hershkovitz
*Attorney, Agent, or Firm*—Mason, Fenwick & Lawrence

[57] ABSTRACT

A fluid supply circuit for supplying three motors includes means for sequentially connecting two of the motors to the supply conduit of the third motor as the pressure in the supply conduit rises through first and second threshold levels. The circuit includes a manual override for suppressing the automatic sequential action. The circuit is applied to the control of the booms and bucket of a hydraulic excavator, and provides for semi-automatic digging.

2 Claims, 8 Drawing Figures

25
29
34
13
13a
13b
19
18
60
22
33
135a
39
28
12
12a
12b
17
16
59
21
38
132a
79
27
31
11
11a
11b
15
14
158
120
30
144
161
126
146
45
69a
77
78
76
74
72
73
65
75
68
64
67
66
80
71

DEVICE FOR SEQUENTIALLY SUPPLYING SEVERAL HYDRAULIC MOTORS

This is a division of application Ser. No. 733,957, filed Oct. 19, 1976, now abandoned.

This invention relates to fluid circuits.

Devices for sequentially supplying several hydraulic motors, so that the motors can be operated automatically, are already known, especially in the field of hydraulic excavators. It has been found, however, that the known devices are not sufficiently adaptable, so that certain desirable sequence operations cannot be carried out.

The invention is intended to overcome this disadvantage by providing a new supply device which is remarkable for the number of operations which can be carried out in service, and for the ease with which they can be carried out.

Accordingly, the present invention provides a circuit for supplying fluid under pressure to three motors each having at least one drive chamber, the circuit comprising:

A fluid distributor;

connecting means for connecting the fluid distributor to a source of fluid under pressure;

a first conduit connecting a drive chamber of one of said motors to the fluid distributor, said fluid distributor being selectively operable to isolate said drive chamber or to connect said drive chamber to said connecting means;

a second conduit for connecting the first conduit to a second of said motors;

a third conduit for connecting the first conduit to the third of said motors; and first and second sequence valves interposed respectively in said second and third conduits, the first sequence valve being adapted to interrupt the second conduit when the pressure in the first conduit falls below a first predetermined value, and the second sequence valve being adapted to interrupt the third conduit when the pressure in the first conduit falls below a second predetermined value.

Each sequence valve is preferably connected to a main fluid control device which is connected, possibly in a selective manner, to the first conduit.

For certain uses, it is advantageous for the circuit to be connected to two sources of fluid under pressure which are selectively connected, both together or one at a time, to the first conduit. In this case, each sequence valve is preferably connected to a secondary fluid control device, which opposes the action of the corresponding main element and which is selectively connected to a source of drive fluid, while the effective connection of said secondary element to said source of drive fluid is coincident with the selection of the connection of said first conduit to only one of the main fluid sources.

Finally, it is very often the case that the three motors are operated not only in accordance with the previously defined sequences, but also each independently of the others. In this case, the second and third conduits are each connected by a linking conduit to a fluid source, while a fluid distributor selectively provides for continuity and for interruption of said linking conduit.

The invention will be better understood and secondary features and their advantages will emerge from the following description of embodiments given by way of example.

It will be understood that the description and drawings are given by way of non-limiting example only.

Reference will be made to the accompanying drawings, in which.

Figure 1:
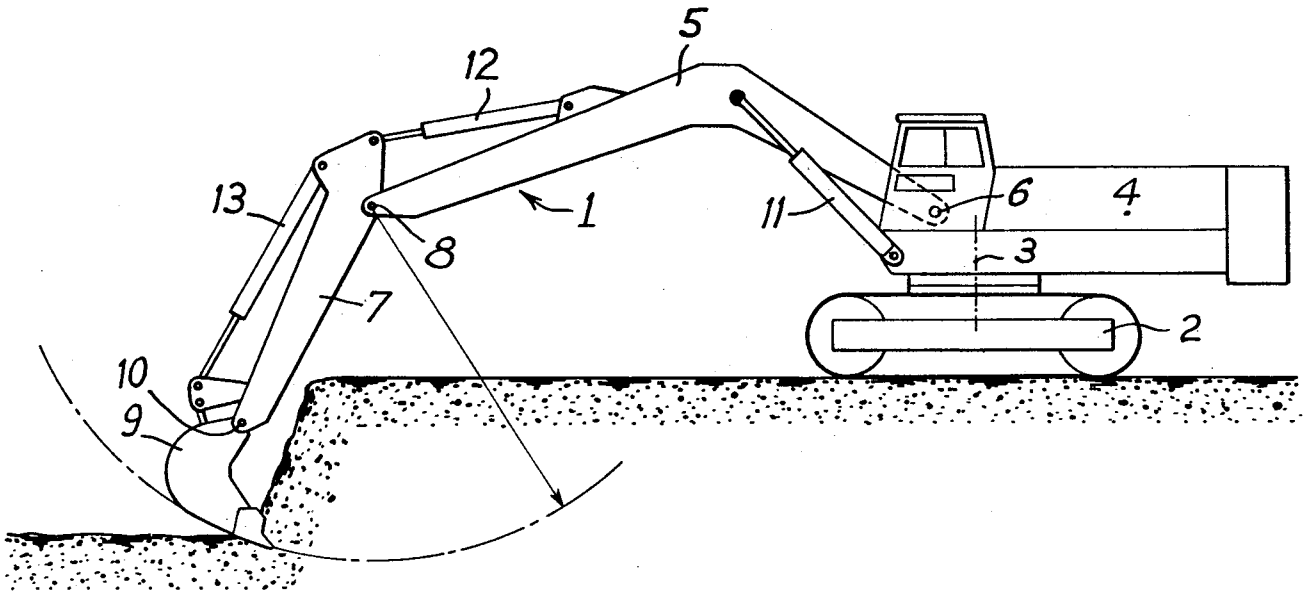
FIG. 1 is an elevation of a hydraulic excavator, the working equipment of which is supplied by means of an embodiment of circuit in accordance with the invention.

The pressurised fluid supply circuits which will be described are used for the control of the hydraulic rams of the working equipment 1 of a hydraulic excavator. The excavator comprises a crawler-tracked chassis 2 on which is mounted a turret 4 which turns about a vertical axis 3. The working equipment 1 includes a main boom 5 pivotally connected to the turret 4 about a horizontal axis 6, a secondary boom 7 pivoted to the end of the main boom 5 about an axis 8 which is parallel to the axis 6, and a bucket 9 pivoted to the end of the secondary boom 7 about an axis 10 parallel to the axis 6. The relative positions of the various parts of the working equipment are controlled by means of double-acting rams 11, 12 and 13, connected between the turret 4 and the main boom 5, between the main boom 5 and the secondary boom 7, and between the secondary boom 7 and the bucket 9, respectively.

Figure 2:
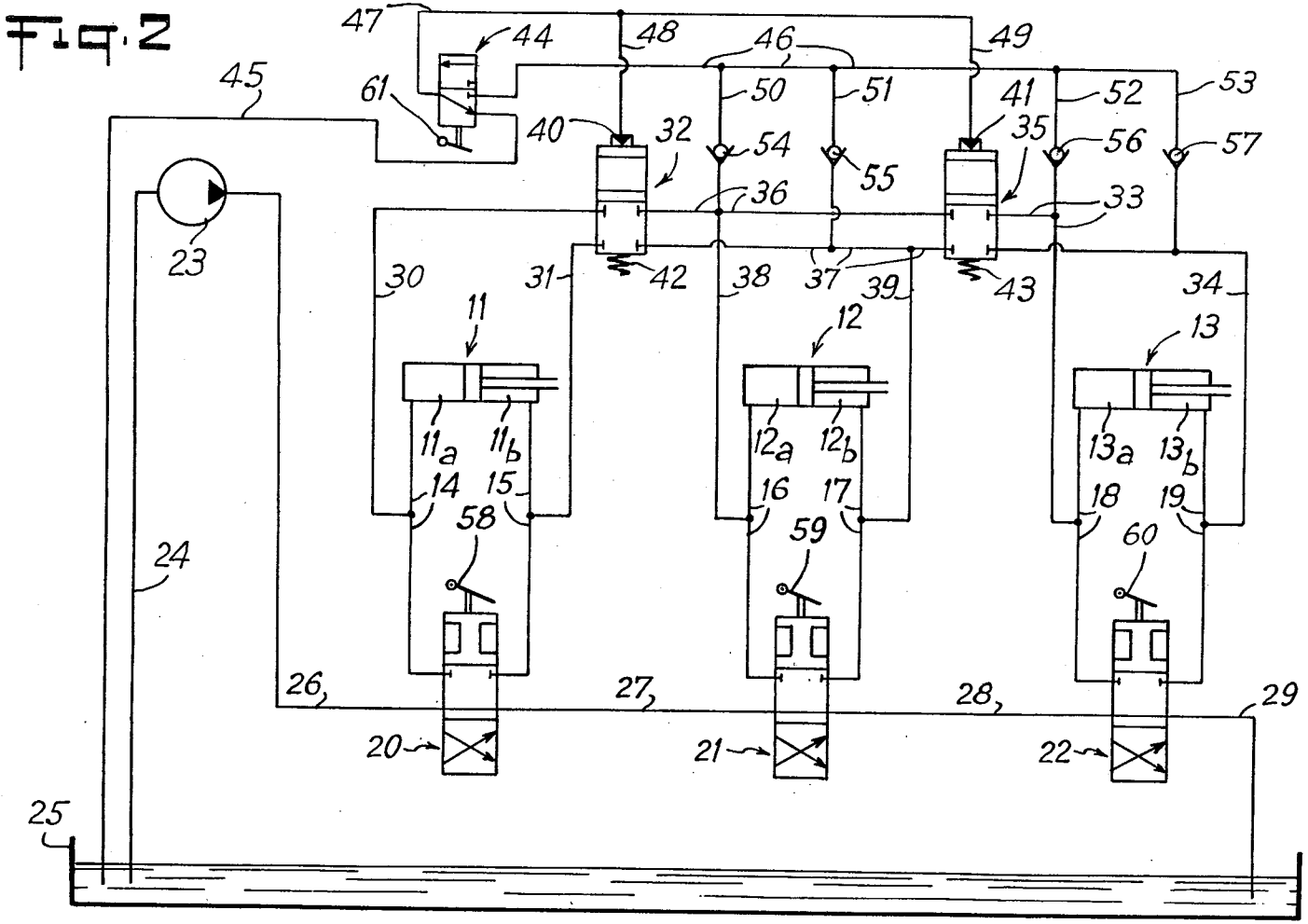
FIG. 2 shows the circuit for supplying the working equipment of the excavator shown in FIG. 1, in a first, non-automatic, operational mode.

A first embodiment of the circuit for supplying the rams 11, 12 and 13 is shown in FIG. 2.

Each ram has two chambers 11*a* and 11*b*, 12*a* and 12*b*, 13*a* and 13*b*, and these are connected by conduits 14, 15, 16, 17, 18 and 19 to respective three-position fluid distributors 20, 21 and 22. The distributors shown are of the series type, but may be of any suitable type, for example of the parallel type.

A pump 23 has its suction conduit 24 connected to a fluid reservoir 25 and its discharge conduit 26 connected to the distributor 20. The distributors 20 and 21 are interconnected by a conduit 27, whilst distributors 21 and 22 are interconnected by a conduit 28. The distributor 22 is connected to the reservoir 25 by a conduit 29.

The first position of the distributor 20 corresponds to the connection of conduit 14 to conduit 26 and of conduit 15 to conduit 27, the second position to the connection of conduit 26 to conduit 27 and the closing off of conduits 14 and 15, and the third position to the connection of conduit 15 to conduit 26 and of conduit 14 to conduit 27.

The first position of distributor 21 corresponds to the connection of conduit 16 to conduit 27 and of conduit 17 to conduit 28, the second position to the connection of conduit 27 to conduit 28 and to the closing off of conduits 16 and 17, and the third position to the connection of conduit 17 to conduit 27 and of conduit 16 to conduit 28.

The first position of distributor 22 corresponds to the connection of conduit 18 to conduit 28 and of conduit 19 to conduit 29, the second position to the connection of conduit 28 to conduit 29 and to the closing off of conduits 18 and 19, and the third position to the connection of conduit 19 to conduit 28 and of conduit 18 to conduit 29.

The conduits 14 and 15 are connected by conduits 30 and 31 to a sequence valve 32, whilst conduits 18 and 19 are connected by conduits 33 and 34 to another sequence valve 35. The valves 32 and 35 are interconnected by conduits 36 and 37, which are themselves connected to conduits 16 and 17 by conduits 38 and 39, respectively.

The valves 32 and 35 are provided with respective control rams 40 and 41 and springs 42 and 43 opposing the action of the corresponding rams.

A two-position distributor 44 is connected to the reservoir 25 by a conduit 45, and is also connected to two conduits 46 and 47. Conduit 47 is connected to the rams 40 and 41 by conduits 48 and 49 respectively, whilst conduit 46 is connected to conduits 36, 37, 33 and 34 by conduits 50, 51, 52 and 53, respectively. Non-return valves 54, 55, 56 and 57 in the conduits 50, 51, 52 and 53 allow fluid to flow only towards the conduit 46.

The first position of the distributor 44 corresponds to the connection of conduit 45 to conduit 47 and to the closing off of conduit 46, whilst the second position of distributor 44 corresponds to the connection of conduit 46 to conduit 47 and to the closing off of conduit 45.

The first position of valve 32 corresponds to the connection of conduit 30 to conduit 36 and of conduit 31 to conduit 37, and to the predominance of the action of the ram 40 over that of the spring 42, whilst the second position of this valve corresponds to the closing off of conduits 30, 31, 36 and 37.

The first position of valve 35 corresponds to the connection of conduit 36 to conduit 33 and of conduit 37 to conduit 34, and to the predominance of the action of the ram 41 over that of the spring 43, whilst the second position of this valve corresponds to the closing off of conduits 36, 37, 33 and 34.

It should be noted that the distributors 20, 21, 22 and 44 are manually operated, by means of hand levers 58, 59, 60 and 61, respectively.

Figure 7:
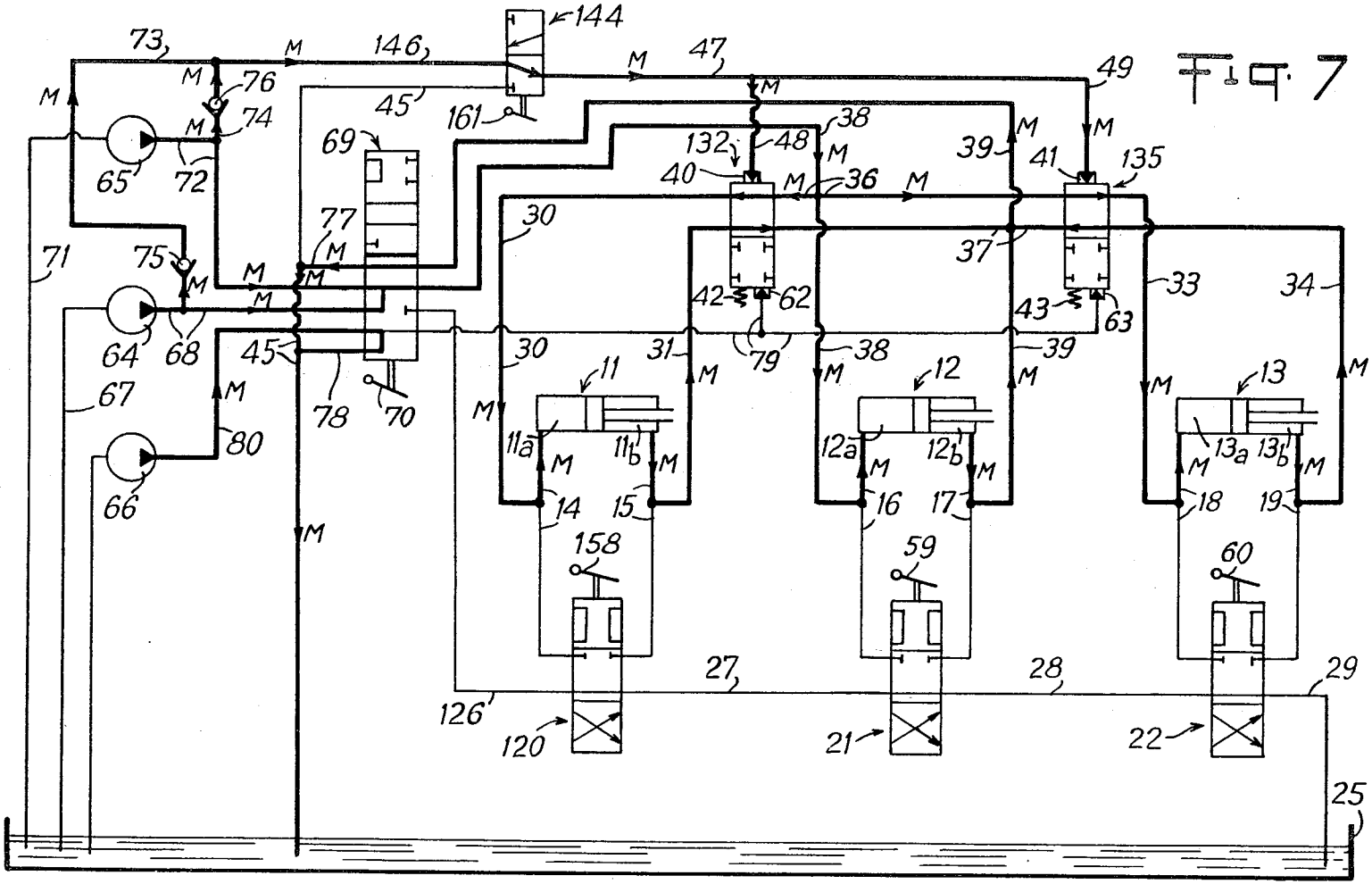
FIG. 7 shows a second embodiment of circuit in accordance with the invention, in a first operational mode.

The second embodiment of the supply circuit is shown in FIG. 7. This embodiment includes various items which have already been described with reference to FIG. 2. This applies to the rams 11, 12 and 13, and to the distributors 21 and 22.

A distributor 120 replaces the distributor 20 and has the same function as distributor 20, but with reference to conduits 126, 14, 15 and 27, rather than conduits 26, 14, 15 and 27. Likewise the sequence valves 32 and 35 are replaced by valves 132 and 135 which are distinguished from the valves 32 and 35 only by the addition of complementary control rams 62 and 63 which act in opposition to the rams 40 and 41 without, in this instance, overcoming their action. The distributor 44 is replaced with a similar distributor 144 with the same function as distributor 44, but with reference to conduits 146, 45 and 47 rather than conduits 46, 45 and 47.

The circuit also comprises two main pumps 64 and 65 and a drive fluid pump 66. Main pump 64 has its suction conduit 67 connected to the reservoir 25 and its discharge conduit 68 connected to a two-position primary distributor 69 having a manual control member 70. Conduit 126 is also connected to distributor 69. Main pump 65 also has its suction conduit 71 connected to the reservoir 25 and its discharge conduit 72 connected to the distributor 69. Conduits 73 and 74 incorporating non-return valves 75 and 76 connect conduits 68 and 72, respectively, to the conduit 146. The non-return valves 75 and 76 allow fluid to flow only towards the conduit 146.

Conduits 38 and 39 now connect conduits 16 and 17 to the distributor 69, and conduits 77 and 78 connect distributor 69 to conduit 45. A conduit 79 connects the distributor 69 to the rams 62 and 63, and the discharge conduit 80 of the pump 66 is connected to the distributor 69.

The first position of distributor 69 corresponds to the connection of conduit 72 to conduit 77, of conduit 68 to conduit 126, and of conduit 80 to conduit 79, and to the closing off of conduits 38, 39 and 78. The second position of distributor 69 corresponds to the connection of conduit 77 to conduit 39, to the interconnection of conduits 68, 72 and 38, to the interconnection of conduits 78, 79 and 80, and to the closing off of conduit 126.

Figure 8:
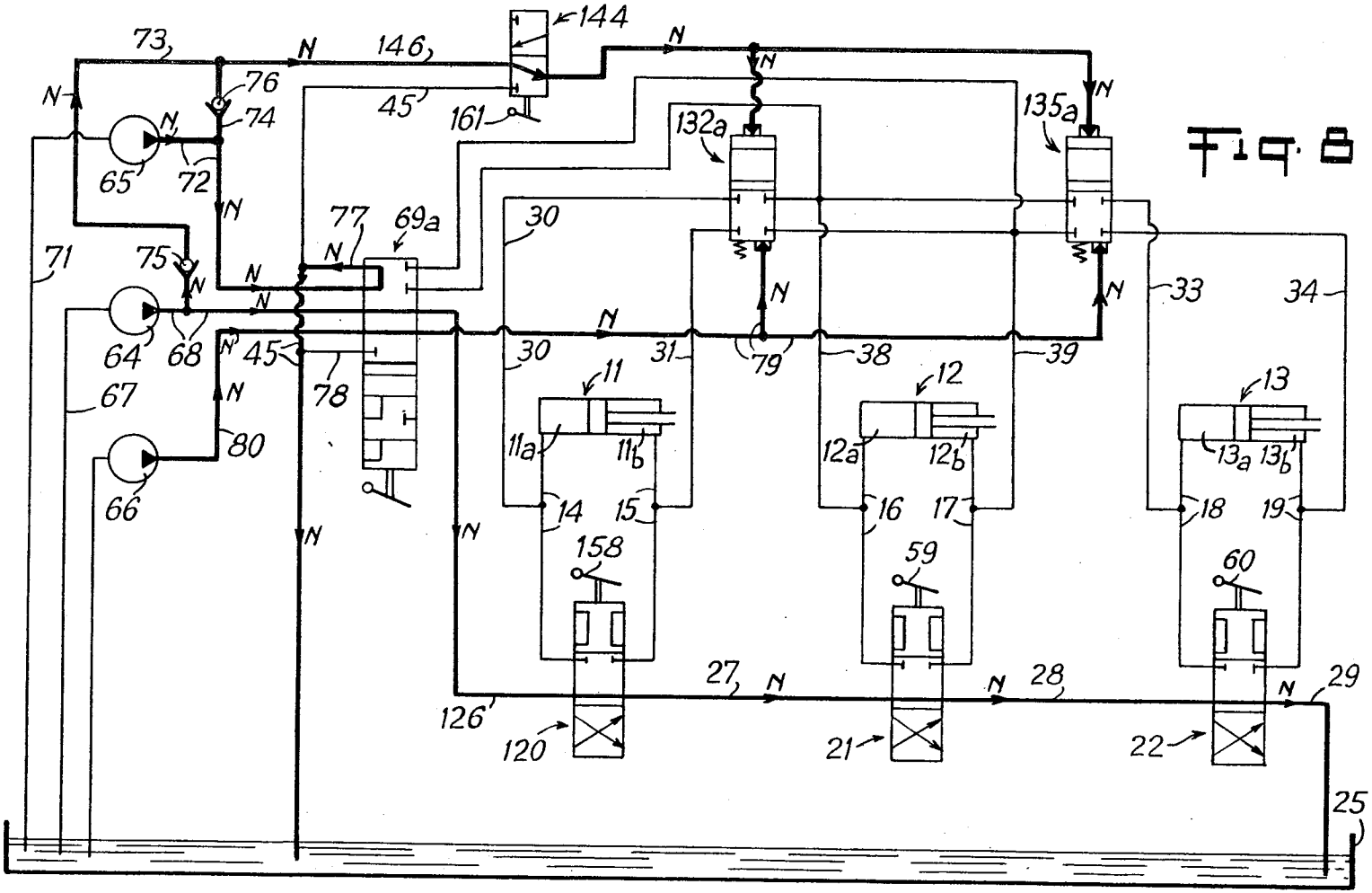
FIG. 8 shows the device of FIG. 7 in a second operational mode.

Each of the two embodiments can have several distinct configurations. In order to explain the operation of each embodiment, FIGS. 3 to 6 show four other configurations of the device shown in FIG. 2, and FIG. 8 shows another configuration of the device shown in FIG. 7.

Figure 3:
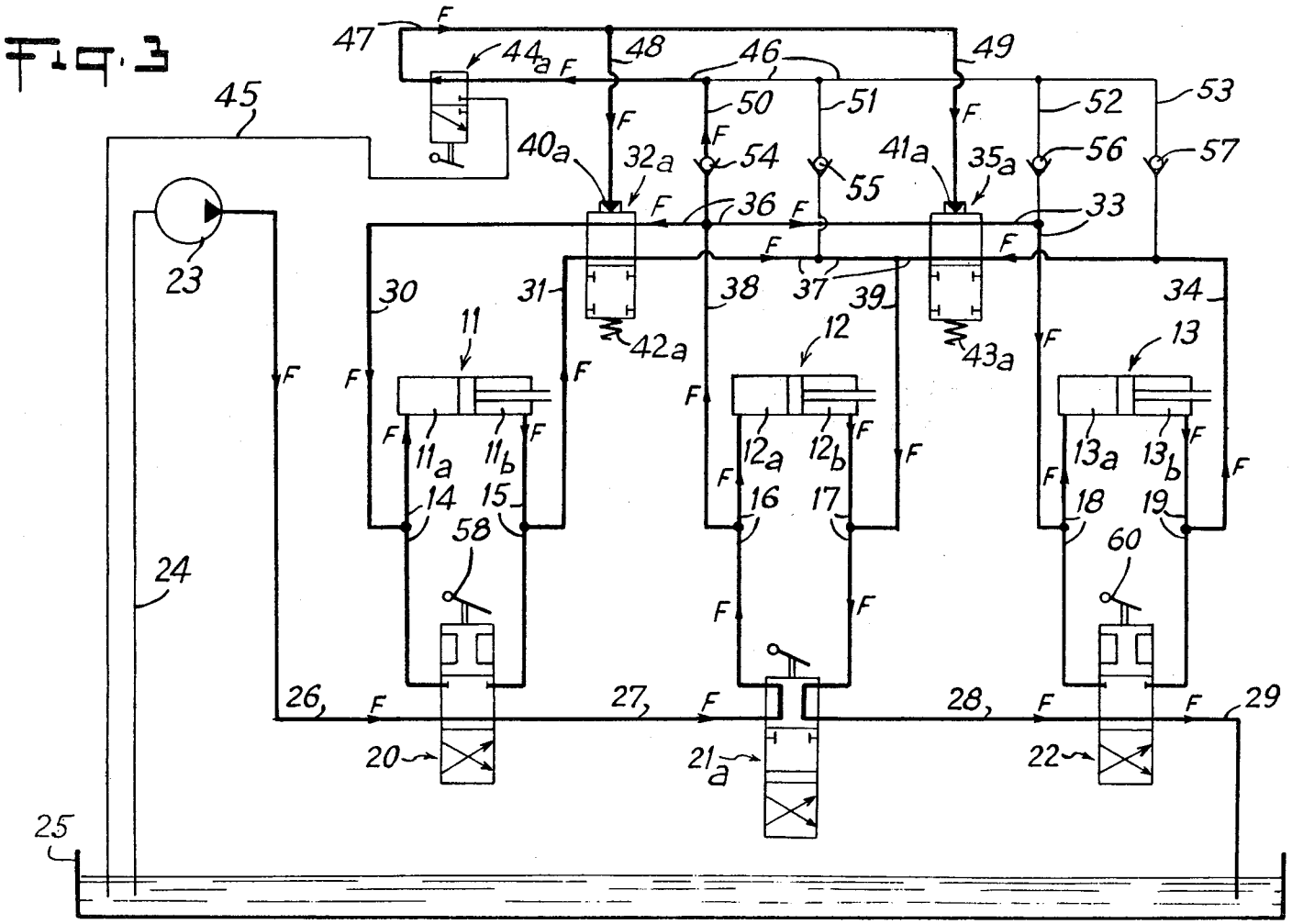
FIGS. 3 to 6 show the circuit of FIG. 2 in a second, automatic, operational mode, in four distinct configurations which correspond to four distinct uses.

The arrangement of FIG. 3 can be obtained from that of FIG. 2 by changing the positions of distributor 21 and 44 and of sequence valves 32 and 35. Thus the distributor 21 is moved from its second position to its first position 21*a*, the distributor 44 is moved from its first position to its second position 44*a*, and the sequence valves 32 and 35 are moved from their second positions to their first positions 32*a* and 35*a*. Distributors 20 and 22 remain in their second positions. It should be noted that the fluid flow is indicated by the arrows F.

Figure 4:
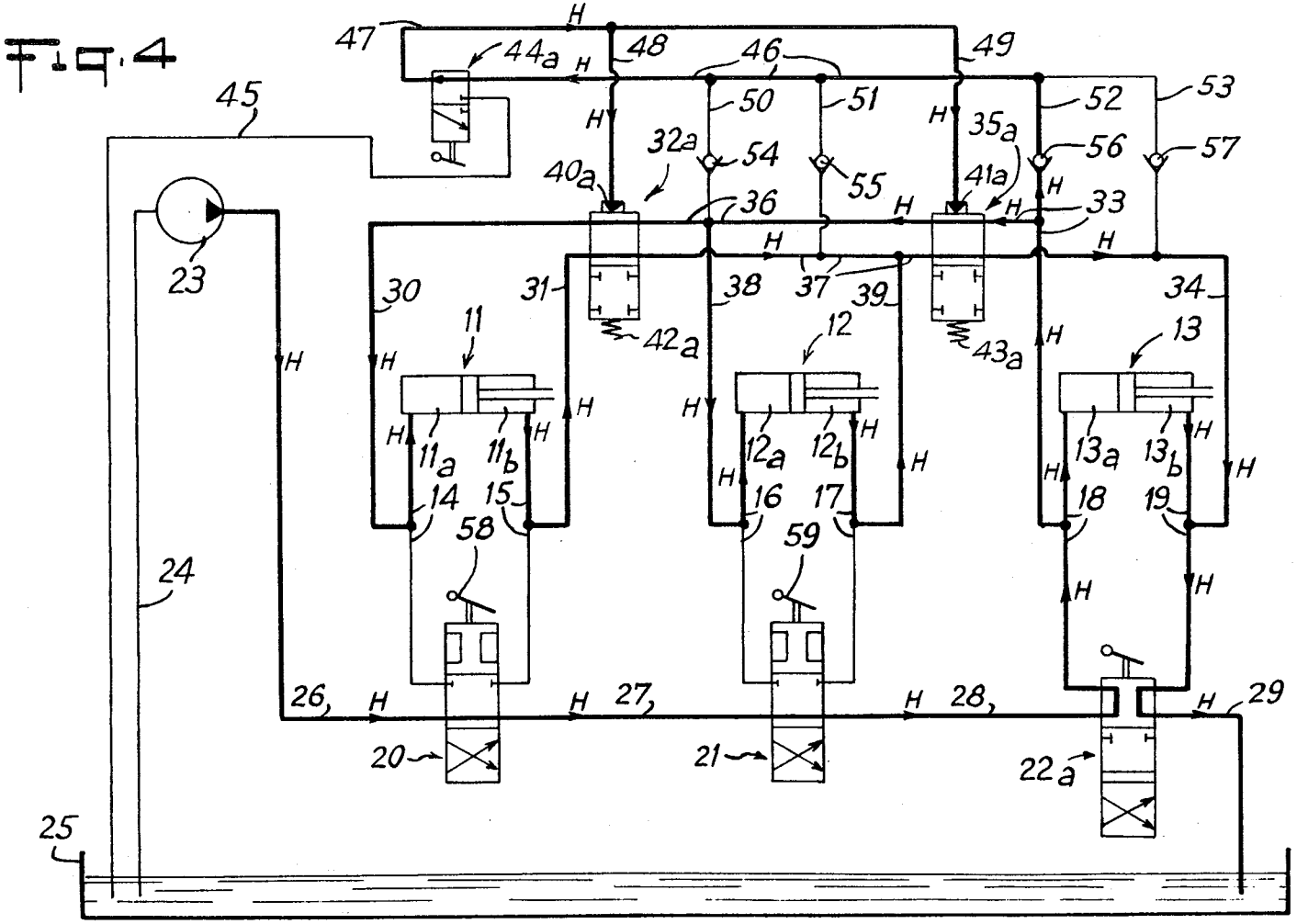

The arrangement of FIG. 4 is obtained from that of FIG. 3 by replacing the distributor 21 in its second position and moving the distributor 22 from its second position to its first position 22*a*. The fluid then flows in the directions of the arrows H.

Figure 5:
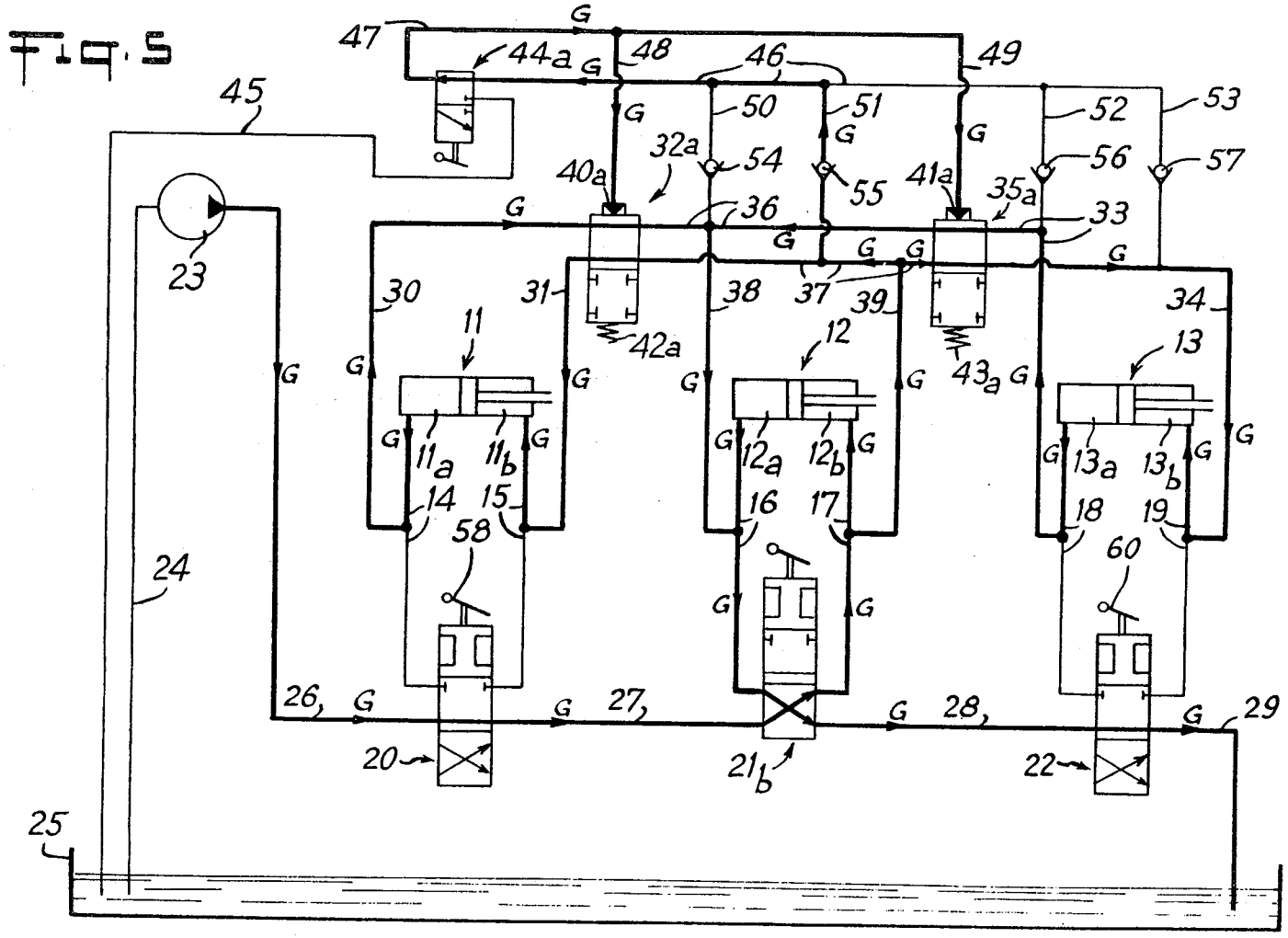

The arrangment of FIG. 5 is obtained from that of FIG. 3 by moving the distributor 21 from its first position 21*a* to its third position 21*b*. The fluid then flows in the direction of the arrows G.

Figure 6:
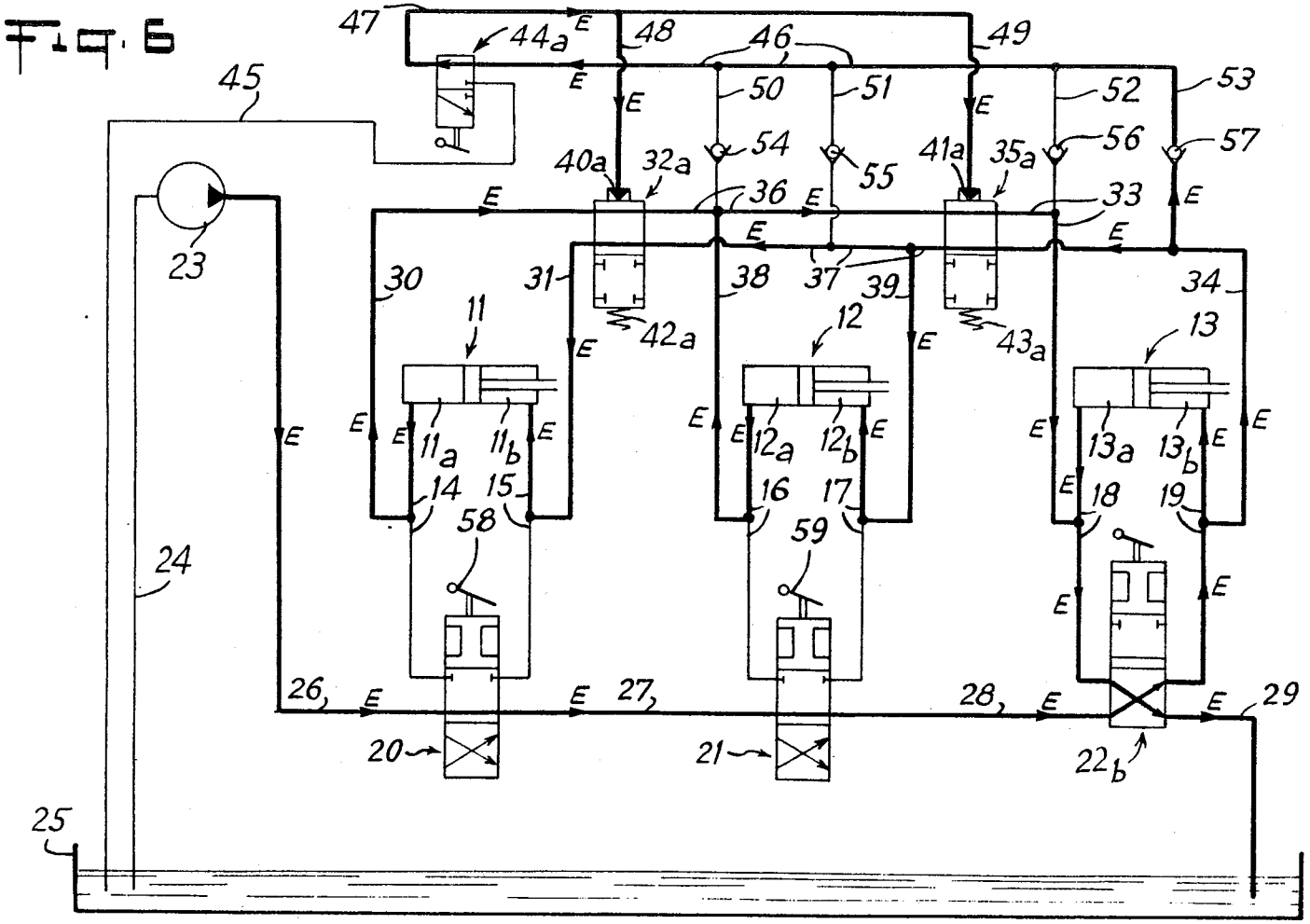

Finally, the arrangement of FIG. 6 is obtained from that of FIG. 3 by replacing the distributor 21 in its second position and moving the distributor 22 from its second position to its third position 22*b*. The fluid then flows as shown by the arrows E.

In FIG. 7 the distributors 120, 21, 22 and 69 are set in their respective second positions and the distributor 144 and the sequence valves 132 and 135 are set in their first positions. The fluid then flows as shown by the arrows M.

The arrangement of FIG. 8 is obtained from that of FIG. 7 by moving the distributor 69 from its second position to its first position 69*a*. The sequence valves 132 and 135 pass from their first positions to their second positions 132*a* and 135*a*. The fluid then circulates as shown by the arrows N.

The operation of the excavator fitted with the supply circuit of FIGS. 2 to 6 will now be explained.

Depending on whether the distributor 44 is in its first position 44 (FIG. 2) or in its second position 44*a* (FIGS. 3 to 6), the movements of the rams 11, 12 and 13 are either completely independent or inter-dependent in sequence, and when inter-dependent can be made independent at any time.

In the configuration shown in FIG. 2, the fluid contained in the rams 40 and 41 is at zero excess pressure, as it is in communication with the reservoir 25 via the conduits 48, 49, 47 and 45. The sequence valves 32 and 35 are thus held in their second positions by the springs 42 and 43, so that the conduits 30, 31 and 33, 34 are held isolated from conduits 36, 37. Because of this, each of the rams 11, 12 and 13 is controlled only by its respective distributor 20, 21 or 22. As has already been explained, the movements of the three rams are independent of one another, and the position of the secondary boom 7 relative to the main boom 5 can be adjusted by means of the ram 12, the main boom 5 remaining fixed in position relative to the turret 4, and the bucket 9 remaining fixed in position relative to the secondary boom 7, if this is what the operator wishes.

In the configuration of FIGS. 3 to 6, when one of the drive chambers of one of the three rams (chamber 12*a* of ram 12 in FIG. 3, chamber 13*a* of the ram 13 in FIG. 4, chamber 12*b* of the ram 12 in FIG. 5, chamber 13*b* of the ram 13 in FIG. 6) is supplied with fluid under pressure from the pump 23 by operation of the distributor corresponding to the ram in question, the pressure of the fluid in that chamber is communicated by one of the conduits 50, 51, 52 or 53 to the conduit 46, and from conduit 46 to rams 40 and 41 via conduits 47, 48 and 49. When the pressure in the drive chamber in question exceeds predetermined values, corresponding to the respective calibrations of the springs 42 and 43, the sequence valves are moved from their second positions towards their first positions, 32*a* and 35*a*.

When this is done, communication is established between the chambers of the ram being supplied and the corresponding chambers of each other ram which is connected to a sequence valve which is in its first position. The movement of one and then two or three of the rams 11, 12 and 13 is thus controlled by a single distributor, in a sequence determined by the calibration pressures of the rams 40 and 41, which correspond to the strengths of the springs 42 and 43. Automatic operation is thus obtained. The automatic operation can be interrupted at any time, however, by direct manual operation of the distributors 20, 21, or 22. Finally, automatic operation can be totally shut down by placing the distributor 44 in its first position 44 (see FIG. 2 and description above).

The operation of the configurations of FIGS. 3 to 6 will now be described in detail, the calibration pressure of the ram 40*a* of the sequence valve 32*a*, corresponding to the ram 11 for moving the main boom 5, being, in the example described, greater than that of the ram 41*a* of the sequence valve 35*a*.

With reference to FIG. 3, the supply of the chamber 12*a* of the ram 12 with pressurised fluid causes the secondary boom 7 to be pulled back under the main boom 5. As soon as the pressure in chamber 12*a* reaches the calibration pressure of the valve 35*a* pressurised fluid also reaches chamber 13*a*, causing the bucket 9 to be pulled back under the secondary boom 7. Finally, when the pressure in the chamber 13*a* reaches the calibration pressure of the valve 32*a*, pressurised fluid reaches chamber 11*a* and causes the main boom 5 to be lifted. The configuration shown is that for automatic digging by manual maneuver of the secondary boom 7, in the course of which the bucket 9 is filled, pivots when filled and is lifted by means of the main boom 5.

FIG. 4 shows the configuration for automatic digging by manual maneuver of the bucket 9. The chamber 13*a* of the ram 13 is filled first, then the chamber 12*a*, and then, finally, the three chambers 13*a*, 12*a* and 11*a*. This provides another automatic digging method, which may on certain occasions be preferable to that provided by the configuration of FIG. 3.

Deploying of the working equipment 1 may also be automatic. Thus FIG. 5 shows the configuration for automatic deployment by manual maneuver of the secondary boom 7, chamber 12*b* of the ram 12 being supplied alone at first, followed by chambers 12*b* and 13*b*, and, finally, chambers 12*b*, 13*b* and 11*b*.

The configuration shown in FIG. 6 is for automatic deployment by manual maneuver of the bucket 9 the bucket being moved alone at first, then the bucket and the secondary boom, and finally the bucket, the secondary boom and the main boom.

Particular note should be taken of the parallel connection of the conduits 48 and 49 to the conduit 47, and therefore of the rams 40 and 41. Because of this, the sequence valves 32 and 35 are controlled independently of one another, which allows the sequence initially set up to be modified, by simply adjusting the calibrations in the springs 42 and 43, to the extent that the order in which the valves operate can be reversed.

Furthermore, the possible applications are not limited to those of the given example of a hydraulic excavator, and more particularly encompass all cases in which three motors must be controlled automatically, whether of the linear or rotary type.

Finally, while maintaining the principle of automation which has just been described, it is possible to provide for supply by means of a single main pump 64 (FIG. 8) or two main pumps 64 and 65 (FIG. 7), at the operator's choice.

With the distributors 120, 21, 22, 69 and 144 in their second positions (FIG. 7), the delivery of pumps 64 and 65 is directed to the conduit 38. The chamber 12*a* is thus supplied. Also the pressure of the fluid in chamber 12*a* acts equally on the rams 40 and 41, by way of the conduits 73, 74, 146, 47, 48 and 49. According to the calibration of the sequence valves 132 and 135, chambers 12*a*, 13*a* and 11*a* are automatically supplied, as already explained with reference to FIG. 3. It should be noted that the drive fluid pump 66 discharges into the reservoir 25 via conduits 80, 78 and 45, so that there is no pressure in the rams 62 and 63. The FIG. 7 configuration corresponds to automatic control with the outputs of the two pumps 64 and 65, and thus to fast maneuvers, which can be carried out on soft ground.

If the FIG. 7 configuration is modified by placing the distributor 144 in its first position, the rams 40 and 41 are connected to the reservoir 25, and the sequence valves 132 and 135 are set permanently into their second positions, so that only chamber 12*a* is supplied. Only the secondary boom 7 is moved.

When the ground is hard, fast operation is no longer possible. So only the output of the single main pump 64 is used for supplying the rams 11, 12 and 13 (FIG. 8). Pump 65 discharges into the reservoir 25 via the conduits 72, 77 and 45. But the drive fluid pump 66 supplies rams 62 and 63 through the conduits 80 and 79. The automatic operational modes of FIGS. 3 to 6 can again be achieved, noting that the pressures required in the rams 40 and 41 to move the valves 132*a* and 135*a* to their second positions 132, 135 are greater than those which are required in the FIG. 7 configuration because of the opposing actions of the rams 62 and 63. This is what is required, as in hard ground the maximum control pressures of the rams 11, 12 and 13 must be greater than in soft ground, so that the automation does not prematurely cause the lifting of an only partly filled bucket.

In this case too, of course, setting the distributor 144 into its second position permanently neutralises the automatic system, so that the rams 11, 12 and 13 are only operated by manually actuating their respective distributors 120, 21 and 22.

In the embodiment shown in FIGS. 7 and 8, it will have been noted that the control pressure of the rams 40 and 41 comes directly from the pump 64 or from pumps 64 and 65, so that it is not reduced by any load loss which might occur in the passage of the fluid through one of the distributors 20, 21, 22 or 120, 21, 22.

The invention is not limited to the embodiments which have been described, but covers all modifications thereto which do not exceed the scope and spirit of the invention.

What is claimed is:

1. A circuit for supplying fluid under pressure to fluid motors each having at least one drive chamber, the circuit comprising:

first, second and third fluid motors each having at least one drive chamber;

a fluid distributor;

connecting means for connecting the fluid distributor to a source of fluid under pressure;

a first conduit connecting a drive chamber of one of said motors to the fluid distributor, said fluid distributor being selectively operable to isolate said drive chamber or to connect said drive chamber to said connecting means;

a second conduit for connecting the first conduit to a second of said motors;

a third conduit for connecting the first conduit to the third of said motors;

a fourth conduit for connecting the fluid distributor to the first motor through a first distributor, the second motor through a second distributor, and the third motor through a third distributor, the first, second and third distributors having a closed position blocking said fourth conduit and at least one open position allowing flow through said fourth conduit;

first and second sequence valves interposed respectively in said second and third conduits, the first sequence valve being adapted to interrupt the second conduit when the pressure in the first conduit falls below a first predetermined value, and the second sequence valve being adapted to interrupt the third conduit when the pressure in the first conduit falls below a second predetermined value wherein each sequence valve is provided with a main fluid operated control device which is connected to the first conduit;

wherein said connecting means comprises first and second supply conduits adapted to be connected to respective sources of fluid under pressure;

said fluid distributor including means for selectively coupling one or both of said supply conduits to the first conduit;

a secondary fluid operated control device coupled to each sequence valve in opposition to the corresponding main fluid operated control device; and said fluid distributor further includes means for connecting the secondary fluid operated control devices to a source of fluid under pressure when one only of the supply conduits is connected to the first conduit and said first, second and third distributors are in their open positions.

2. A circuit for supplying fluid under pressure to fluid motors each having at least one drive chamber, the circuit comprising:

first, second and third fluid motors each having at least one drive chamber;

a primary fluid distributor;

connecting means for connecting the primary fluid distributor to a source of fluid under pressure;

a first conduit connecting a drive chamber of the first one of said motors to the primary fluid distributor, said primary fluid distributor being selectively operable to isolate said drive chamber or to connect said drive chamber to said connecting means;

a second conduit for connecting the first conduit to a second of said motors;

a third conduit for connecting the first conduit to the third of said motors;

a fourth conduit for connecting the fluid source through the primary fluid distributor to the first motor through a first distributor to the second motor through a second distributor and to the third motor through a third distributor, the first, second and third distributors having plural positions including a closed position blocking said fourth conduit and at least one open position allowing flow through said fourth conduit;

first and second sequence valves interposed respectively in said second and third conduits, the first sequence valve being adapted to interrupt the second conduit when the pressure in the first conduit falls below a first predetermined value, and the second sequence valve being adapted to interrupt the third conduit when the pressure in the first conduit falls below a second predetermined value wherein each sequence valve is provided with a main fluid operated control device which is connected to the first conduit;

wherein said connecting means comprises first and second supply conduits adapted to be connected to respective sources of fluid under pressure;

said primary fluid distributor including means for selectively coupling one or both of said supply conduits to the first conduit;

a secondary fluid operated control device coupled to each sequence valve in opposition to the corresponding main fluid operated control device; and wherein said primary fluid distributor further includes means for connecting the secondary fluid operated control devices to a source of fluid under pressure when one only of the supply conduits is connected to the first conduit and said first distributor is in the open position.

* * * * *